United States Patent [19]

MacDonald et al.

[11] Patent Number: 4,848,057

[45] Date of Patent: Jul. 18, 1989

[54] ROOFING SHINGLES

[75] Inventors: Peter G. MacDonald, Laval; Giuseppe Spinelli, St. Constant; Jayant B. Kandalgaonkar, Dorval, all of Canada

[73] Assignee: Exxon Research and Engineering Company, Florham Park, N.J.

[21] Appl. No.: 611,728

[22] Filed: May 18, 1984

[51] Int. Cl.[4] ..... E04D 1/00

[52] U.S. Cl. ..... 52/518; 52/540; 52/554; 52/557; 52/558

[58] Field of Search ..... 52/526, 527, 528, 540, 52/554, 555, 557, 558, 559, 560, 518

[56] References Cited

U.S. PATENT DOCUMENTS

| | | | |
|---|---|---|---|
| B 180,783 | 4/1985 | Walker | 52/557 |
| 835,889 | 11/1906 | Moeller | 52/528 |
| 1,368,947 | 2/1921 | Levis | 52/554 |
| 1,596,272 | 8/1926 | Jordan | 52/554 |
| 1,873,886 | 8/1932 | Heppes | 52/557 |
| 1,976,662 | 10/1934 | Fely | 52/559 |
| 2,000,030 | 5/1935 | Knapp | 52/555 |
| 2,006,270 | 6/1935 | Harshberger | 52/555 |
| 2,058,578 | 10/1936 | Eckert | 52/554 |
| 2,095,249 | 10/1937 | Harshberger | 52/559 |
| 2,132,999 | 10/1938 | Topping | 52/557 |
| 2,153,887 | 4/1939 | Greider | 52/540 |
| 2,305,008 | 12/1942 | Howard | 52/528 |
| 3,231,453 | 1/1966 | Smith | 52/559 |
| 3,332,830 | 7/1967 | Tomlinson | 52/559 |
| 3,848,384 | 11/1974 | Eaton | 52/528 |
| 4,023,321 | 5/1977 | Smith | 52/528 |
| 4,288,959 | 9/1981 | Murdock | 52/556 |

*Primary Examiner*—Henry E. Raduazo

*Attorney, Agent, or Firm*—Roylance, Abrams, Berdo & Goodman

[57] ABSTRACT

A roofing shingle consisting of composite plies of thin sheet material adhered together by asphalt having exposed areas with or without cut outs between tabs, and a flexible region at the end top of the exposed area. The top end of the cut outs may lie in this flexible region.

6 Claims, 2 Drawing Sheets

ROOFING SHINGLES

This invention relates to roofing shingles which are flexible in key areas so that they do not fracture in windy cold conditions and when installing them in cold conditions.

BACKGROUND OF THE INVENTION

Roofing shingles normally include oxidized asphalt which becomes hard and brittle at low temperatures. Even when the product temperature is below 25° C., it becomes difficult to handle; nailing causes hair line cracks around the nail head; and hammer impressions surrounding the nail head develop cracks in coating films that make lines of weakness in the shingle so that they are not able to resist strong wind forces.

This problem is accentuated when the ambient temperature is below 0° C., so much so that at this temperature it is not possible to handle or install roofing shingles as they are far too brittle.

Furthermore, problems are encountered with already installed shingles when exposed to low climatic temperatures as the "self-seal type" adhesives which are often used on shingle remain inactive for a considerably long time especially at temperatures below 35° C. It is conceivable therefore that shingles which are installed at higher temperatures than 25° C. but at temperatures below 35° C. are still "unsealed" when cold conditions are encountered, and a gust of wind can then actually lift the "unsealed tabs" of the shingles and develop serious cracks and holes around the nail or staple head by which the shingle is attached to the roof. If the wind is sufficiently strong, the cold shingle tab will break off, seriously destroying the main function of the shingles which is to protect the roof from leaks.

Problems are also encountered with asphalt roofing shingles wherein the asphalt coating caliper is increased for product performance needs above the customary 0.025 inches to 0.1 inches which is usually above a ratio of coating calibre to cellulosic membrane calibre of 0.75. With this higher ratio of coating caliper to membrane caliper, hair line cracks are relatively easily caused around nail heads, as are cracks in the coating film relatively easily caused by hammer impressions.

The problem is also aggrevated by utilizing a wider than normal width of roofing shingle exposed area or tab size, and although this increases the weight of the tab, there is a larger area for the wind force to act upon and it is therefore easier to bend or snap a larger area or tab under high wind conditions that it is to snap a smaller area or tab especially under cold conditions.

The tops of conventional roof shingle cutouts between tabs are also relatively weak due to their shape.

Problems of cracking and breaking of shingles are also encountered more readily when "unsealed" shingles are used as not only the exposed area or tab of the shingle can lift under high wind conditions but the whole shingle can lift.

The degree of severity of the cracking phenomen is also high especially when glass-mats or polyester fiber mats, which have low basis weight 1 pound per 100 square feet to 3 pounds per 100 square feet and are conventionally very thin and cellulosic "felts" of base weights lower than conventional bone dry 43.7 pounds per 480 square feet are used, as extra amounts of coating asphalts are required to make up for the low membrane weight. Such roofing products make with conventional coating asphalts are exceedingly brittle and unworkable at product temperatures lower than 25° C.

The ability for a roofing shingle to resist damage caused by nailing, stapling, or wind up-lifting, especially at temperatures below 25° C., is dependent upon the quality of the coating asphalt in the key area which is normally damaged.

There is therefore a requirement for a roofing shingle which does not become hard and brittle in key areas in cooler to cold temperatures and is therefore not damaged during installation nor after installation by high winds.

SUMMARY OF THE INVENTION

The roofing shingle of this invention overcomes the problems of known shingles by making the area of the shingle which is prone to damage, during or after installation, flexible by providing a flexible region in the shingle where it is most liable to crack or fracture. Preferably, the flexible region will include a flexible strip made from compounds such as natural rubbers, synthetic polymerized rubbers, plasticizers, etc. Alternatively the flexible region can be obtained by reducing the caliper of the top coating of the shingle.

BRIEF DESCRIPTION OF THE DRAWINGS

In the drawings in which preferred embodiments of the invention are shown.

DETAILED DESCRIPTION OF PREFERRED EMBODIMENTS

Figure 1:
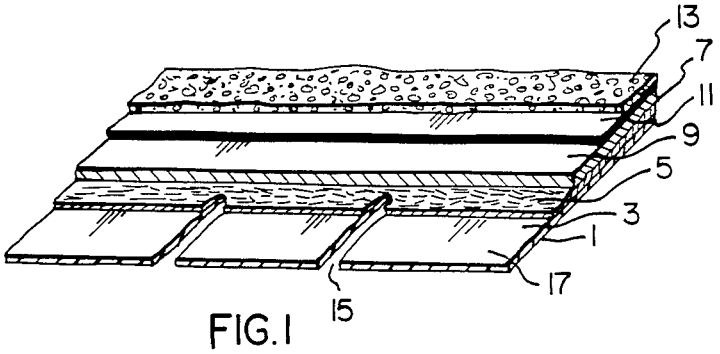
FIG. 1 is a perspective view of a shingle of this invention wherein layers of a shingle material are removed in steps to clearly show the construction.

Referring to the drawings, in FIG. 1, the shingle consists of a back coating 1, a second ply 3, a flexible strip 5 with an asphalt layer 7 at the same level, a first ply 9, a face coating 11 and a layer of granules 13. Thin coatings of asphalt are used to adhere all of those layers together. Normal cut outs 15 are in the exposed portion of the shingle so forming tabs 17. The flexible strip is preferably made from an appropriate quality of asphalt which may be modified with natural rubber, a synthetic polymerized rubber, or a plasticizer and is situated in the region of high bending stress which is across the base of tabs 17 which is the region most likely to bend under the influence of high wind, and is most liable to crack under the influence of nailing or stapling of the roofing shingles onto the roof.

In the shingles of FIGS. 1–4, each shingle has cut outs 15 extending inwardly from the front edge of the shingle. The rear edge is opposite the front edge. Front and rear edge areas are provided adjacent the front and rear edges, respectively, such that the flexible strips (e.g., strip 21 of FIG. 2) are spaced from the rear and front edge areas. The terms upper and lower refer to the upper and lower surfaces of the shingle.

The flexible strip shown in FIG. 1 can be a preformed strip or a strip formed in situ of rubberized-compound or a flexible asphalt which is applied in the form of a strip as the normal asphalt is being applied in that layer. As a practical matter, the normally saturated cellulosic felt or conventional glass mat and synthetic membranes may be coated by laying a ribbon of flexible asphalt in an appropriate location before the conventional coating asphalt is applied. The higher viscosity flexible asphalt retains its position even when normal coating asphalt is flooded over it. Conversly, conventional coating asphalt may be applied first over the membrane, an appropriately designed coating roll may scrape off the conventional coating asphalt from the desired location, and a flexible coating asphalt ribbon can be substituted by an auxiliary flexible asphalt application system.

Figure 2:
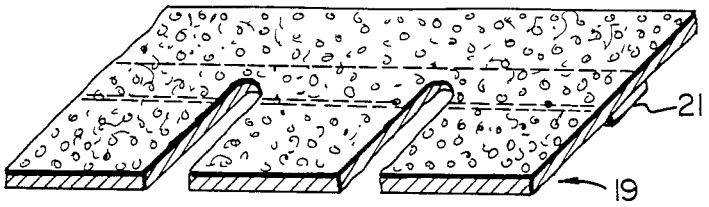
FIG. 2 is a perspective view of a shingle of this invention wherein the flexible strip is situated along the base.

In FIG. 2 there is shown a roofing shingle which consists of a conventional asphalt shingle 19 with a flexible strip 21 made from the same material as strip 5 in FIG. 1, secured to the back of the roofing shingle. The addition of this flexible strip provides flexability to the conventional roofing shingle to prevent it from fracturing or tearing along the base of the tabs. This embodiment is particularly useful for making flexible, glass mat or polyester fibre mat shingles which are conventionally very thin and are more prone to be effected by high wind.

Figure 3:
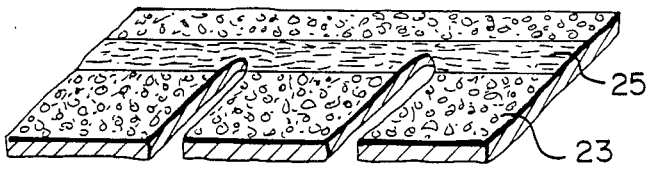
FIG. 3 is a perspective view of a shingle of this invention wherein the flexible strip is situated on the top.

The shingle shown in FIG. 3 shows a conventinal roofing shingle 23 which has a flexible strip 25 of the same material as strip 5 in FIG. 1, laminated on top of the surfacing granules of the shingle so providing a flexible area upon the top of the shingle which prevents cracking due to nails or staples and also tends to prevent cracking of the asphalt under the flexible strip.

Figure 4:
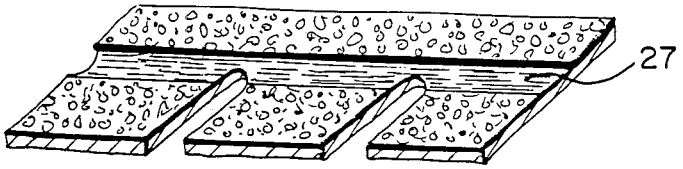
FIG. 4 is a perspective view of a shingle of this invention which is made flexible by reducing the caliper of the coating.

The embodiment of shingle shown in FIG. 4 obtains flexibility in the region wherein damage occurs, by reducing the caliper of the shingle along this region. The reduction in the caliper is achieved by forming a groove 27 in the upper face of the shingle, this groove, in effect, meaning that, at the position of the groove, there is a reduced thickness of face coating.

Figure 5:
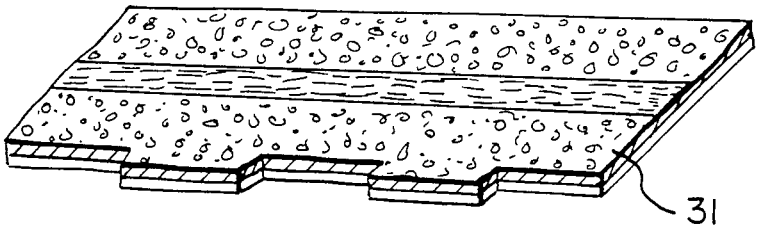
FIG. 5 is a perspective view of a shingle showing a flexible nailing portion on top of the shingle.

In the embodiment shown in FIG. 5 there is shown a shingle having an exposed area 31 which is devoid of cut outs and has shallow projections 33 along the front edge, these being for aesthetic purposes only. The flexible strip 25 is located in the same position as shown in FIG. 3, this position being at the rear of the exposed area and also at the shingle securing position.

Note that the flexible zone for preventing tab or exposed area breakage need not be at the same location as the flexible zone at the shingle securing position wherein the nails or staples penetrate the shingle, however it is preferable for the flexible zone to be at least at the securing position.

Figure 6:
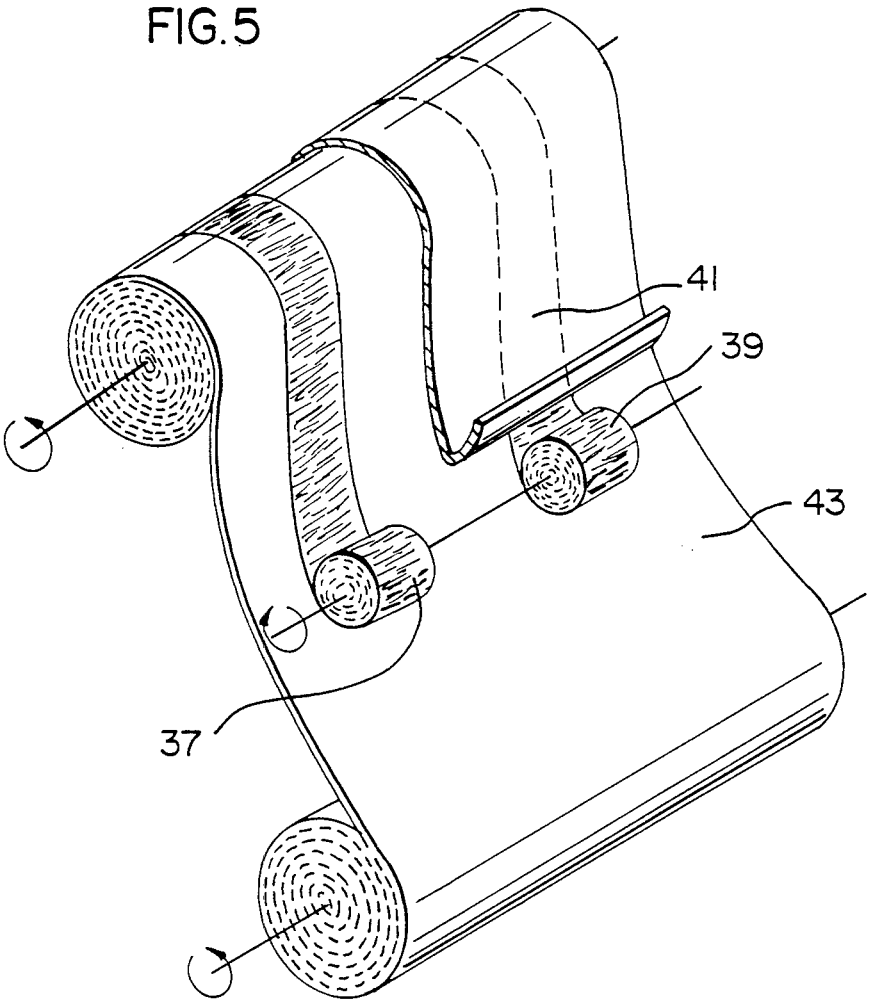
FIG. 6 is a view showing the making of a sheet of material for a double row of shingles.

As an example of the method of making shingles having an internal flexible strip, FIG. 6 shows diagrammatically a method of making the shingle of FIG. 1 when utilizing rolled strips 37 and 39 of flexible material. When normally manufacturing asphalt shingles, a sheet of first ply material 41 is rolled onto a sheet of second ply material 43, both plies passing through an asphalt bath or under asphalt spray heads. The two plies 41 and 43 are therefore bonded together. The total width of material is then cut to form two long rolled strips of shingles which can thereafter be cut into individual shingles. In order to insert the flexible strips 37 and 39, it is merely necessary to introduce the strips from rolls of flexible strip material between the first and second pliesof asphalt material so bonding the flexible strips between the first and second plies. This part of the method is only shown diagramatically in FIG. 6 to indicate the relatively simplicity of introducing flexible strips into the shingles as they are being made.

We claim:

1. A roofing shingle consisting of composite plies of thin, flat, unfolded sheet material adhered together by asphalt and having a back, a front edge and a rear edge, the shingle lying in one plane when installed and having a rear upper edge area adjacent the rear edge, a front upper edge area adjacent the front edge and a securement area between and spaced from the rear and front edge areas, the securement area including a flexible region consisting of a strip of flexible material extending transversely across the back of the shingle for limiting cracking of the shingle during and after installation.

2. The shingle of claim 1 wherein the front edge area includes tabs and cut outs between the tabs, the flexible region extending into the tabs.

3. The shingle of claim 1 wherein the flexible strip is formed of a compound selected from the group consisting of natural rubber, synthetic polymerized rubber and plasticizer.

4. A roofing shingle consisting of composite plies of thin, flat, unfolded sheet material adhered together by asphalt and having a front edge and a rear edge, the shingle lying in one plane when installed and having a rear upper edge area adjacent the rear edge, a front upper edge area adjacent the front edge and a securement area between and spaced from the rear and front edge areas, the securement area including a flexible region for limiting cracking of the shingle during and after installation, the flexible region consisting of a strip of flexible material extending transversely across the shingle between first and second plies of the composite material.

5. The shingle of claim 2 wherein the flexible strip is formed a compound selected from the group consisting of natural rubber, synthetic polymerized rubber and plasticizer.

6. The shingle of claim 4 wherein the front edge area includes tabs and cut outs between the tabs, the flexible region extending into the tabs.

* * * * *